US006708704B2

(12) United States Patent
Lee

(10) Patent No.: US 6,708,704 B2
(45) Date of Patent: Mar. 23, 2004

(54) STRUCTURE FOR AUTOMATIC OPENING UMBRELLA

(76) Inventor: Youth Lee, 6F-5, No. 164, Sec. 4, Nan Jin East Road, Taipei (TW)

( * ) Notice: Subject to any disclaimer, the term of this patent is extended or adjusted under 35 U.S.C. 154(b) by 0 days.

(21) Appl. No.: 10/113,976

(22) Filed: Apr. 2, 2002

(65) Prior Publication Data

US 2003/0183256 A1 Oct. 2, 2003

(51) Int. Cl.[7] ..... E46B 25/16
(52) U.S. Cl. ..... 135/23; 135/29; 135/25.3
(58) Field of Search ..... 135/22, 23, 25.1, 135/27, 29, 31, 25.3

(56) References Cited

U.S. PATENT DOCUMENTS

| | | | | | |
|---|---|---|---|---|---|
| 256,774 | A | * | 4/1882 | Watson | 135/23 |
| 636,936 | A | * | 11/1899 | Worring et al. | 135/23 |
| 2,160,231 | A | * | 5/1939 | Schaefer | 135/26 |
| 3,732,881 | A | * | 5/1973 | Hirai | 135/22 |
| 3,756,258 | A | * | 9/1973 | Yoshihara | 135/22 |
| 4,936,332 | A | * | 6/1990 | Wu | 135/20.3 |
| 5,050,627 | A | * | 9/1991 | Hengtzu | 135/23 |

FOREIGN PATENT DOCUMENTS

| | | | |
|---|---|---|---|
| JP | 6-133813 | * | 5/1994 |
| JP | 7-303509 | * | 11/1995 |

* cited by examiner

*Primary Examiner*—Winnie S. Yip
(74) *Attorney, Agent, or Firm*—Rosenberg, Klein & Lee

(57) ABSTRACT

The present invention relates to a structure for automatic opening umbrella, which mainly includes a runner having a middle connector and a lower connector. A main rib of umbrella frame has its inner end to connect with the upper joint. A supporting rib has its inner end to connect with the middle connector of the runner and has its outer end to connect with middle position of the main rib. A spring has its inner end to connect with the lower connector and has its outer end to connect with the outer end of the supporting rib. The spring will be tensioned as the umbrella is folded to provide a recovery force for automatic opening the umbrella.

3 Claims, 3 Drawing Sheets

STRUCTURE FOR AUTOMATIC OPENING UMBRELLA

BACKGROUND OF THE INVENTION

A conventional foldable umbrella is provided with a coin spring around a shaft above a runner, which is also around the shaft. A middle joint is provided above the coin spring. As the umbrella is folded, the coin spring will be tensioned to provide a force for automatic opening of the umbrella. Since the runner and the middle joint are manufactured independently and connected by the coin spring, they add inconvenience to production and assembly. Moreover, everyone, including the old and the young will not be able to easily operate the umbrella given the high elastic strength of the coin spring.

Accordingly, a primary object of the invention is to provide an inventive structure for automatically opening an umbrella, which includes a single runner with a middle connector and a lower connector and a spring connected between the lower connector and the main rib of an umbrella frame. Now the features and advantages of the present invention will be described in detail with reference to the accompanying drawings.

BRIEF DESCRIPTION OF ACCOMPANYING DRAWINGS

DETAILED DESCRIPTION OF THE EMBODIMENTS

Figure 1:
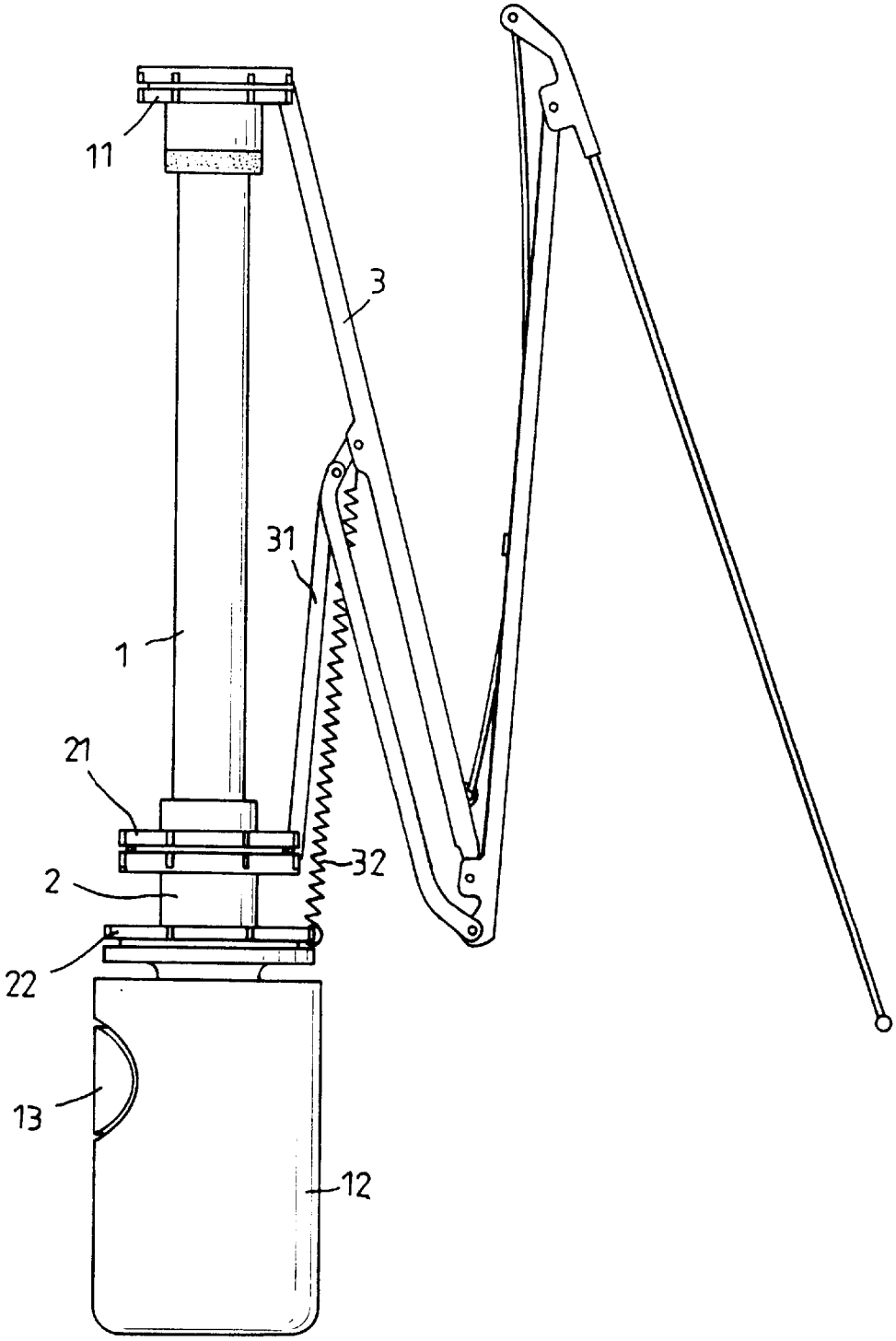
FIG. 1 is a plan view showing a foldable umbrella in folded state according to the present invention.
Figure 2:
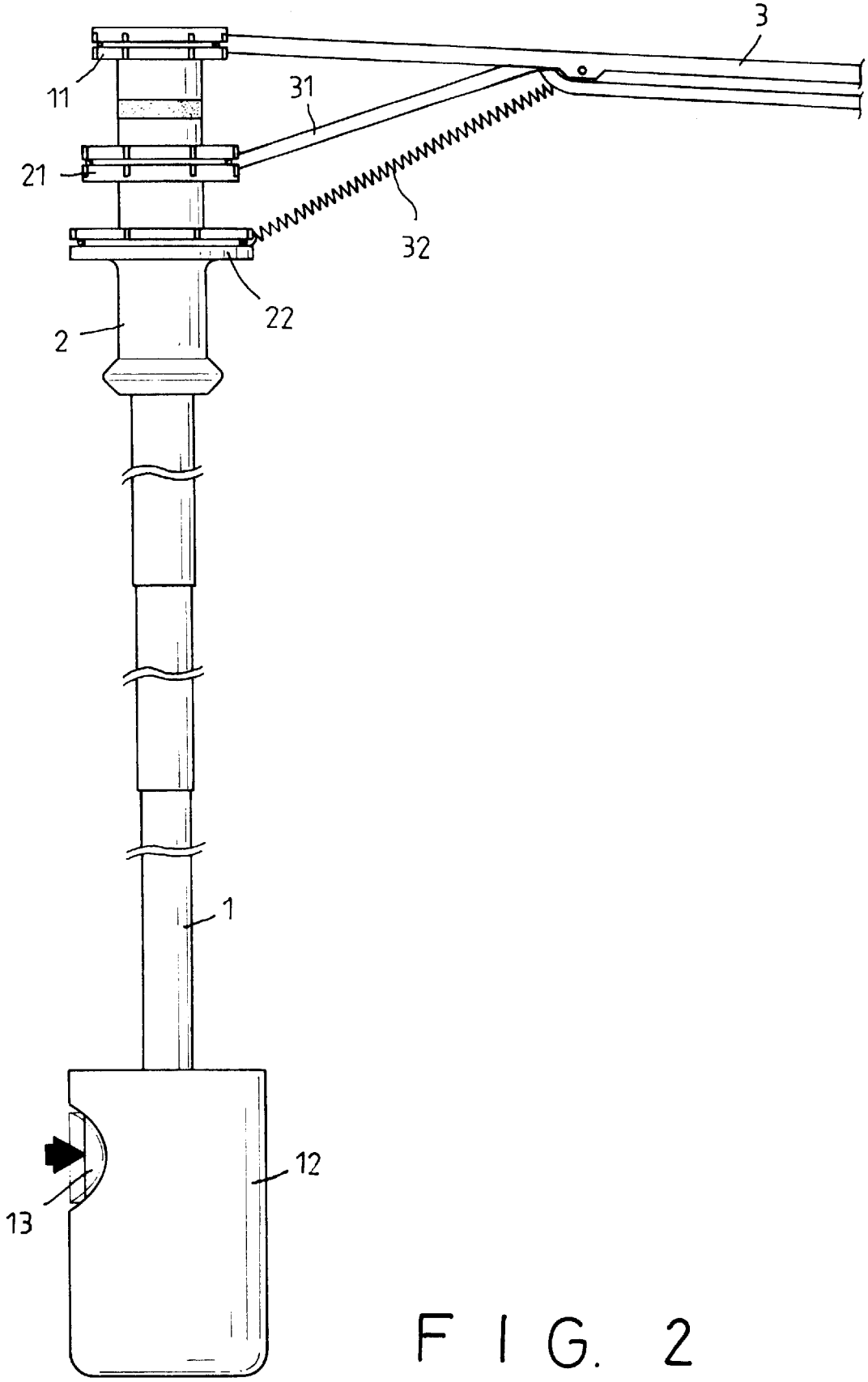
FIG. 2 is a plan view showing the foldable umbrella in opened state according to the present invention.
Figure 3:
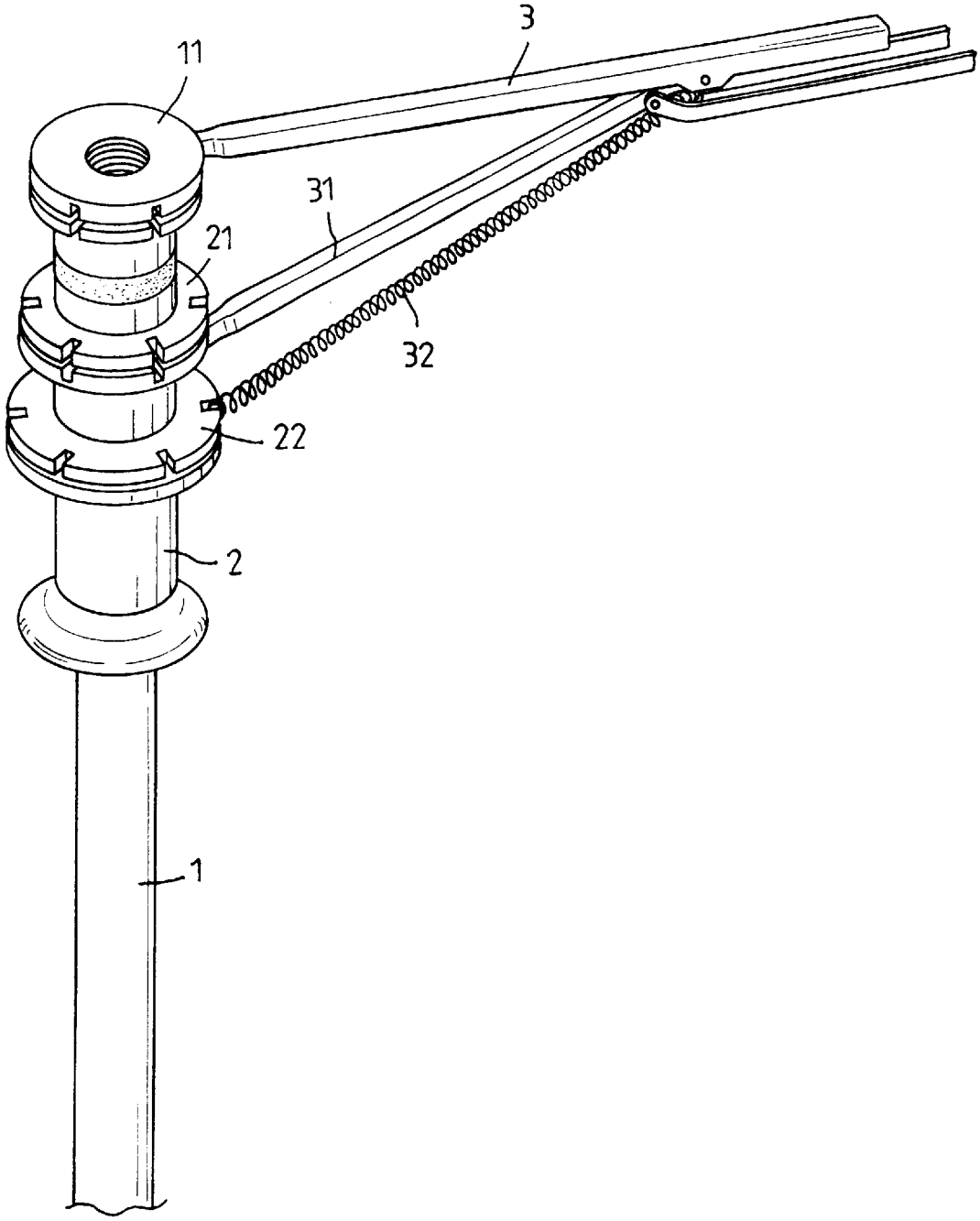
FIG. 3 is a perspective view showing a part of the opened foldable umbrella according to the present invention.

Please refer to FIGS. 1 to 3; the present invention includes a shaft (1) having several tubes. An upper joint (11) is connected on the top of the shaft (1) and a handle (12) is connected with the bottom end of the shaft (1). A runner (2) is provided around the shaft (1) and is moveable. The frame has ribs to connect with the upper joint (11) and the runner (2) to become a normal foldable umbrella. The characteristic of the present invention is that the runner (2) includes a middle connector (21) and a lower connector (22) of different diameters. A main rib (3) of the frame has its inner end to connect with the upper joint (11). A supporting rib (31) has its inner end to connect with the middle connector (21) of the runner (2) and has its outer end to connect with a middle position of the main rib (3). A spring (32) has its inner end to connect with the lower connector (22) and has its outer end to connect with the outer end of the supporting rib (31).

When the umbrella is closed and folded as shown in FIG. 1, the spring (32) is tensioned with recovery force. As pressing a button (13) on the handle (12), referring to FIGS. 2 and 3, the recovery force will cause the runner (2) being moved upward to open the umbrella automatically. Since the runner of the present invention is a single body, it can be produced and assembled conveniently. The spring can be also provided easily.

Accordingly, the invented assembly of the present invention obviously obtains utility and improvement. It should be allowed for patent and is applied.

What is claimed is:

1. A structure for automatic opening umbrella comprising a shaft having a plurality of tubes, an upper joint connected at a top of the shaft and a handle connected at a bottom end of the shaft; a displaceable runner provided about the shaft; a frame having ribs connected to the upper joint and the runner to form a foldable umbrella; the runner including first and second connectors and a tubular portion extending axially therebetween, the first and second connectors being unequal in radial extent, the ribs of the frame including a main rib having its inner end connected to the upper joint, a longitudinally extending supporting rib having its inner end connected to the first connector of the runner and having its outer end connected to an intermediate point of the main rib, and a longitudinally extending spring having its inner end connected to the second connector and having its outer end connected to the intermediate point of the main rib, the spring being tensioned as the umbrella is folded to provide a recovery force for automatically opening the umbrella, the spring and supporting rib being maintained to extend from the intermediate point of the main rib in laterally spaced manner along substantially their longitudinal lengths one relative to the other both in opened and closed positions of the umbrella.

2. The structure for automatic opening umbrella as recited in claim 1 wherein the second connector of the runner is greater than the first connector in radial extent, the second connector being disposed on the runner axially lower than the first connector.

3. The structure for automatic opening umbrella as recited in claim 1 wherein the spring is disposed to extend in an upwardly inclined manner from the runner when the umbrella is in a fully opened configuration.

* * * * *